United States Patent [19]

Sos

[11] Patent Number: 4,783,976

[45] Date of Patent: Nov. 15, 1988

[54] STAMPED KNITTING TOOL FOR TEXTILE MACHINES, PARTICULARLY KNITTING MACHINES

[75] Inventor: Sigmund Sos, Albstadt, Fed. Rep. of Germany

[73] Assignee: Theodor Groz & Söhne & Ernst Beckert Nadelfabrik Commandit-Gesellschaft, Albstadt-Ebingen, Fed. Rep. of Germany

[21] Appl. No.: 163,731

[22] Filed: Mar. 3, 1988

[30] Foreign Application Priority Data

Mar. 4, 1987 [DE] Fed. Rep. of Germany ..... 3706856

[51] Int. Cl.[4] ..... D04B 35/04

[52] U.S. Cl. ..... 66/121; 66/123

[58] Field of Search ..... 66/121, 123, 117, 119

[56] References Cited

U.S. PATENT DOCUMENTS 4,036,036 7/1977 Ashmead ..... 66/123
4,562,705 1/1986 Berentzen ..... 66/121

FOREIGN PATENT DOCUMENTS 2553547 6/1976 Fed. Rep. of Germany ..... 66/123
2610078 7/1977 Fed. Rep. of Germany ..... 66/123
57-9433 2/1982 Japan ..... 66/123

*Primary Examiner*—Ronald Feldbaum
*Attorney, Agent, or Firm*—Spencer & Frank

[57] ABSTRACT

A stamped knitting tool for textile machines, particularly knitting machines, including a shank having at least one butt and at least one closed or open-edged free space or opening formed in the shank and filled with a heterogeneous material firmly bonded to the needle shank. The shank edges outlining the free space or opening are given an irregular profile with which the heterogeneous material is anchored in the shank in a form-locking manner. According to a preferred embodiment, the shank has two spaced solid guide portions extending between its upper and lower edges with one of the guide portions being disposed in alignment with and below the butt, and at least one narrow web portion having a maximum height of 1.1 mm connecting the two guide portions together so that the facing edges of the guide portions and an edge of the web portion or portions defines the opening in the shank. In this embodiment, the material filling the opening and bonded to the shank in a form locking manner is a vibration damping material.

20 Claims, 3 Drawing Sheets

FIG.1
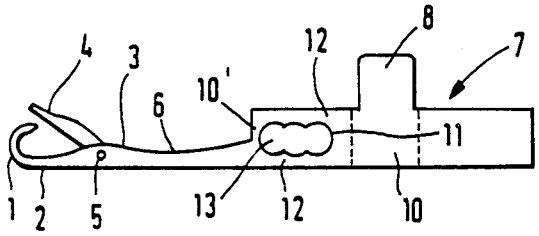
FIG.2
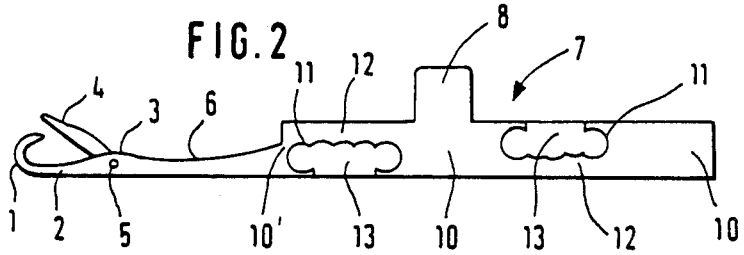
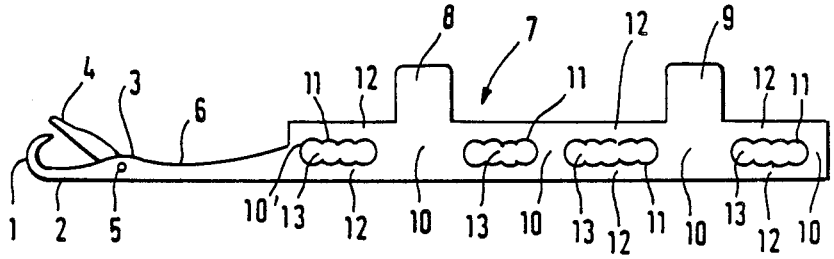
FIG.3

FIG. 4
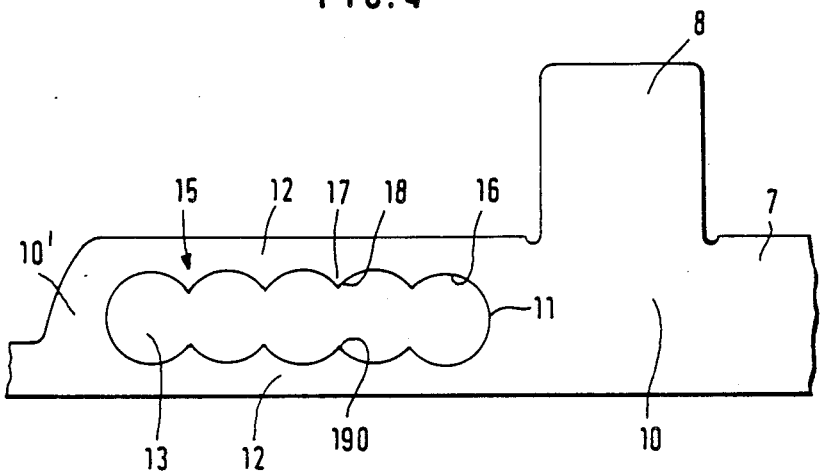
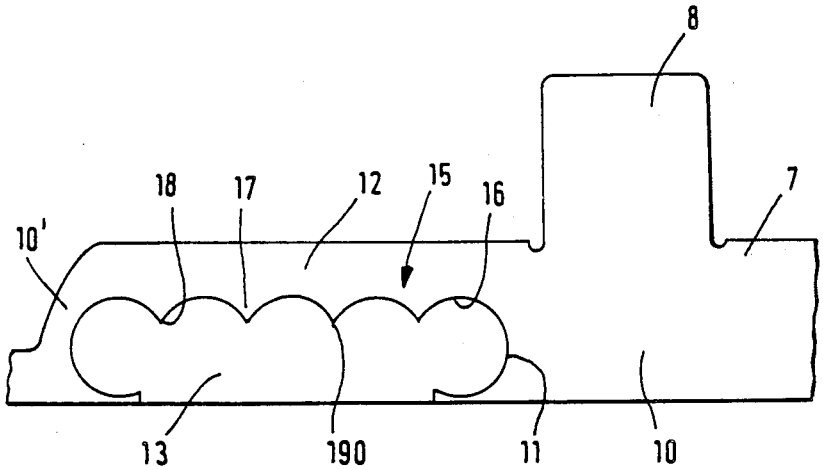
FIG. 5

FIG.6
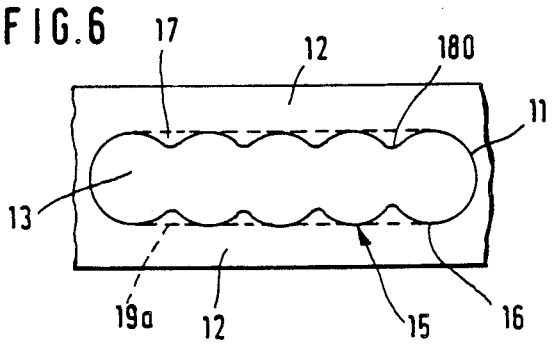
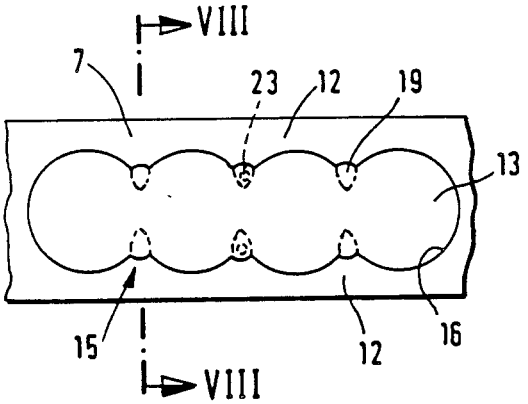
FIG.7
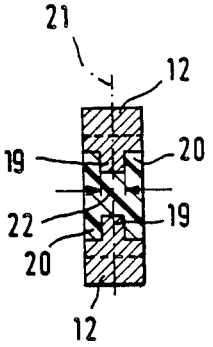
FIG.8

STAMPED KNITTING TOOL FOR TEXTILE MACHINES, PARTICULARLY KNITTING MACHINES

BACKGROUND OF THE INVENTION

1. Field of the Invention

The present invention relates to a stamped knitting tool for textile machines, particularly knitting machines, of the type which generally includes a shank provided with at least one butt and with the shank having at least one closed or open-edged free space, hole or opening filled with a heterogeneous material, for example a plastic, which is firmly bonded to the shank. More specifically and preferably, the knitting tool is of the type wherein the shank is provided with at least one butt and includes two guide portions extending from the upper edge of the shaft to the lower edge of the shank with one of the guide portions being disposed below the butt and with both guide portions being connected together by at least one narrow web, having a maximum height of 1.1 mm, so that the web together with the guide members define a free space or opening which is filled with a vibration damping material firmly bonded to the shank.

The term "knitting tool" as used in this application is intended to include latch needles, composite needles, needles without latches, for example, plush hooks for the production of plush goods, as well as sinkers.

2. Description of the Prior Art

Federal Republic of Germany Pat. No. 3,314,908, corresponding to U.S. Pat. No. 4,562,705 which is incorporated herein by reference, discloses a stamped or punched knitting tool for flat-bed or circular knitting machines whose shank has at least one butt and at least two spaced solid guide portions which extend from the upper edge to the lower edge of the shank. One of these guide portions is aligned with and disposed below the butt. Both of the spaced guide portions are connected by at least one narrow web portion having a maximum height of 1.1 mm so that the guide portions and the web portion or portions define an opening, hole or free space in the shank. This opening is filled with a vibration damping material which is firmly bonded to the needle shank. The vibration damping material can be an elastic plastic having high damping characteristics. However, the use of other materials is not excluded.

According to the above cited patent the opening or free space defined when a single narrow web portion is used to connect two adjacent guide portions may open toward the lower or toward the upper edge of the shank. Alternatively, when two adjacent guide portions are connected together by two web portions, each having a maximum height of 1.1 mm, the opening is completely enclosed by the web portions and the guide portions. Different embodiments having one or a plurality of openings are described.

Such knitting tools, and particularly needles, have been found to be excellent in practice. It has been found that the vibration behavior of these knitting tools, when configured into a highly elastic structure having web heights of a maximum of 1.1 mm, is advantageously influenced by the vibration damping material contained in the opening, particularly when operating the tools for long periods of time and/or at very high operating speeds. Moreover, practical experience has shown that breaking of the web portions due to material fatigue or breaks of hook do not occur to a noticeable degree after long periods of operation or at high operating speeds.

However, the vibration damping material filling the opening is able to develop the above beneficial effect only if it is firmly bonded to the shank material along the edges defining the opening. Particularly for very fine knitting tools (i.e. knitting tools whose shank thickness is very small), the area defining the outline of the opening and available for a bond between the shank material and the vibration damping material is very narrow. However, particularly when such needles are utilized in particular knitting machines in which, during operation they are driven out of the needle bed to such an extent that, in the driven-out position, the opening filled with the vibration damping material projects beyond the needle bed on the side of the hooks, the needle shank may be subjected to considerable lateral forces in the region of the opening. If these lateral forces are so strong that they cause the needle shank to be noticeably deflected transversely to the longitudinal axis of the needle, the bond between the vibration damping material filling the opening and the web and guide portion edges outlining or defining the opening is subjected to very high stresses. If these stresses cause the vibration damping material to break loose from the edges defining the opening at some points, or even break out of the opening, interference with the vibration damping characteristic of the material filling the opening results. This may lead to more or less undamped transversal bending vibrations sufficient to cause material fatigue of the highly elastic needle element in the web portions of the needle with continued operation.

SUMMARY OF THE INVENTION

It is an object of the present invention to provide a knitting tool of the above identified type having a vibratory material located in an opening in the shank wherein inadvertent loosening of the bond between the material and the web and/or guide portions is prevented even under high stresses in the region of the opening.

The above object is generally achieved according to the present invention by a knitting tool of the above type wherein the edges of the web portions and/or guide portions surrounding and defining the opening are provided with an irregular profile so as to anchor the vibration damping material in a form-locking manner. The irregular profile is such that the edges are non-continuous and/or non-linear.

On the one hand, the irregular profile enlarges the surface area available for forming a bond between the material filling the opening and the surrounding needle shank portions. On the other hand, the form-locking anchoring of the material filling the opening and the irregular profiled configuration provides for a significantly improved introduction of any bending stresses which might occur into the material, as well as for stress relief of the bonded faces between the material and the surrounding needle shank portions. Thus, the present invention ensures, even for very fine knitting tools having the above mentioned highly elastic configuration in which two guide portions are connected with one another by means of at least one narrow web portion having a maximum height of 1.1 mm, that the vibration damping material remains firmly bonded to shank portions defining the opening (or openings), so that the vibration damping characteristic of the material remains intact, over long periods of time and high operating speeds.

Although the invention is preferably intended for highly elastic needles, it is not limited to this field. For example, Japanese Utility Model No. 57-9433 discloses that normal latch needles may have either closed openings or a recess opening in the solid shank adjacent the needle butt with the opening extending to the back of the shank, with these openings or recesses being filled with a vibration absorbing material, for example, felt or a synthetic resin. The vibration absorbing material extends beyond the side surfaces of the needle shank. The purpose of this arrangement is to constrain transverse movement of the needle within the needle groove and to prevent slithering movement of the needle which may be caused by impacts applied to the needle butt. The vibration absorbing material extending laterally over the sides of the needle shaft and engaging in the surfaces defining the needle groove then will prevent such lateral vibration.

The present invention can also be used to solve the above-mentioned problem in needles or generally in knitting tools of the type which have a heterogeneous material filling at least one opening provided, for other reasons in the shank in the form of a closed or open-edged recess. This is accomplished by providing the edges of the shank outlining the opening with an irregular profile with which the heterogeneous material is anchored in a form-locking manner.

It has been found to be advantageous for the irregular profile to be given open-edged recesses facing toward the opening. For manufacturing reasons as well as stability of the narrow webs in highly elastic needles, it is advisable for the recesses to be shaped in the form of circular segments, and these recesses to be advantageously arranged so that adjacent recesses overlap or tangentially contact one another. An alternative which has been found preferable for certain dimensions and configurations of knitting tools, particularly because of manufacturing considerations is for the adjacent recesses be slightly spaced from one another. A spacing of about 0.1 mm, with this distance being measured along the edges of the opening between the edges of adjacent recesses, has often been found to be sufficient for manufacturing.

In a preferred embodiment, the irregular profile may include regions which have a reduced wall or edge thickness and extend into the material filling the opening, thereby forming their own "anchors" embedded in the material to provide additional security against premature loosening.

These reduced wall or edge thickness regions may extend in the form of strips around the opening or may only extend around a part thereof, but it is particularly advantageous if they are locally confined and configured to project into the opening. In the above-mentioned embodiment in which the irregular profile is provided with adjacent recesses, it has been found particularly expedient for the reduced edge or wall thickness regions to include gusset-shaped parts formed at the edge transition between adjacent recesses.

The reduced wall thickness regions may be disposed along the longitudinal center axis of the shank and may extend symmetrically to the longitudinal center axis toward the lateral sides of shank. Thus, the reduced wall thickness components which act as "anchors" are completely surrounded by the material filling the opening, with the same amount of the material being disposed on both sides thereof.

In practice, it has been found to be advantageous if the remaining thickness in the reduced edge or wall thickness regions is approximately equal to one-half the thickness of the shank. Moreover, according to a further modification, the reduced edge or wall thickness regions are provided with transverse perforations which are filled with the vibration damping material. This measure produces rivet-like transverse connections between the material and the surrounding shank portions to provide additional positive anchoring.

Particularly, for these embodiments of the invention wherein only one web portion is provided, so that the openings extend and are open along one shank edge, the bonding of the vibration damping material to the shank of the knitting tool is further improved if the irregular profile extends over the entire length of the shank edges defining the opening. In the case of the above mentioned highly elastic needles, this means that the irregular profile extends over their entire web length and the edge surfaces of the guide members facing the respective opening. However, it is possible to devise embodiments in which the irregular profile is provided only over part of the outline of the respective opening.

BRIEF DESCRIPTION OF THE DRAWINGS

FIG. 1 is a schematic side view of a first embodiment of a latch needle according to the invention.

FIG. 2 is a schematic side view of a second embodiment of a latch needle according to the invention.

FIG. 3 is a schematic side view of a third embodiment of a latch needle according to the invention.

FIG. 4 is an enlarged side view of a portion of the latch needle according to FIG. 1 showing the closed opening filled with the vibration damping material in greater detail.

FIG. 5 is an enlarged side view of a portion of the latch needle according to FIG. 2 showing the edge opening filled with vibration damping material in greater detail.

FIG. 6 is a side view of a portion of a latch needle similar to FIG. 4, showing a modification of the profile of the edges defining the opening.

FIG. 7 is a side view of a section of the latch needle similar to FIG. 4, showing a further modified embodiment of the edges defining the opening including the regions of reduced wall thickness.

FIG. 8 is a cross-sectional view of the latch needle of FIG. 7, seen along line VIII—VIII of FIG. 7.

DESCRIPTION OF THE PREFERRED EMBODIMENTS

FIGS. 1 to 3 each show a stamped or punched latch needle which, in a conventional manner, includes a head or hook portion 1 followed by a throat 2 which connects to a needle cheek 3 having a longitudinal slot (not shown) in which a latch 4 is pivotally mounted. The pivot axis of the latch is shown at 5.

The needle groove 6 is followed by an elongated shank 7 which is provided with at least a needle butt 8 and may additionally be provided with a pattern butt 9 (see FIG. 3). As shown the butts 8 and 9 extend from the upper edge of the shank 7.

In alignment with and below needle butt 8, there is provided a solid guide portion 10 extending from the upper edge of the shank to the lower edge of the shank. For the sake of clarity in FIG. 1, this guide portion 10 is outlined approximately by two dashed lines. A corresponding, continuous or solid guide portion 10 is also provided below pattern butt 9 in the embodiment of FIG. 3. In each of FIGS. 1-3, a second such guide portion 10', which is significantly narrower than the guide portions 10 below the respective butts 8 or 9, follows groove 6.

In the embodiment according to FIG. 1, an elongate, continuous free space or opening 11 is provided in shank 7 between the two guide portions 10 and 10'. The longitudinal axis of opening 11 is oriented parallel to the line of symmetry of the needle shank 7. At its top (the upper side of the needle) and at its bottom (the back of the needle), opening 11 is defined by respective narrow web portions 12 whose height is a maximum of 1.1 mm.

The opening 11 defined by the facing edges of the two guide portions 10 and 10' and the interior edges of the two narrow web portions 12, is filled with an elastic vibration damping material 13 which is firmly bonded to the surrounding shank material. This vibration damping material 13 is preferably a plastic material. However, other elastic materials, including metals such as aluminum, can also be used for this purpose.

The embodiments according to FIGS. 2 and 3 differ from the embodiment of FIG. 1 in that a plurality of elongate openings 11 are formed in their shanks 7. As shown, each of the openings 11 is filled with the vibration damping material 13 which is firmly bonded at its edges to the shank material.

In contrast to the embodiments according to FIGS. 1 and 3, in the embodiment according to FIG. 2 each of the two openings 11 provided in needle shank 7 is not closed, but rather is open at one of its longitudinally extending edges and is arranged in such a manner that it opens toward the bottom edge of the shank 7 (back of the needle) or to the upper edge of the shank 7 (upper side of the needle), respectively. Each of the two openings 11 is again defined on one side by an edge of a narrow web portion 12 having a maximum height of 1.1 mm and on the other two sides by the facing edges of respective guide portions 10 and 10'. The guide portion 10' adjacent to groove 6' has a width which preferably corresponds approximately to the height of the adjacent web portion 12. This feature also applies for the embodiments according to FIGS. 1 and 3. If a plurality of openings 11 are provided, guide portions 10 are be arranged between these openings 11 and may have different widths (see FIG. 3).

The details of the configuration of the outlines of openings 11 and of the connection between the vibration absorbing material 13 and the surrounding shank material can be seen in FIGS. 4 to 8.

The edge surfaces of web portions 12 surrounding opening 11 and/or of guide portions 10, 10' are given an irregular profile 15 with which the vibration damping material 13 is anchored to the surrounding material of shank 7 in a form locking manner.

As can be seen from FIGS. 4 to 7, the irregular profile 15 in the illustrated embodiment is provided by recesses 16 which are open at the edges toward the opening 11 and are shaped in the form of circular segments. The recesses 16 are arranged successively next to one another as shown in FIGS. 4, 5 and 7 so as to overlap in such a manner that two adjacent recesses 16 enclose an essentially gusset-shaped or triangular region 18, which ends in a point 190, at the regions of transition 17 from one recess 16 to the other.

In the embodiment of FIG. 6, the circular segment shaped recesses 16 do not overlap but rather are arranged so that adjacent recesses 16 are spaced from one another so that small linear outline portions 180 remain between them. The length of the linear outline portions 180 measured along the outline of opening 11 generally need not be more than about 0.1 mm.

The illustrated circular shaped segment configuration of recesses 16 has been found to be of particular advantage when manufacturing possibilities are considered. However, other configurations are also possible for the recesses 16. For example, recesses 16 could be polygonal, wavy or could have a dovetail shape.

To further improve the form-locking connection between the vibration damping material 13 filling opening 11 and the surrounding shank portions, the shank edges forming the irregular profile 15 may be provided with regions 19 which have a reduced edge or wall thickness, and which project into the material 13 filling opening 11. A preferred such embodiment is shown in FIGS. 7 and 8, wherein the reduced edge or wall thickness regions 19 are locally confined and are designed to project into opening 11. As shown, regions 19 are disposed at the transition points 17 between adjacent recesses 16 and include the gusset-shaped or triangular regions 18. Thus, they form approximately pin-shaped "anchors" which are embedded in the vibration absorbing material 13 and additionally support it.

As can be seen from FIG. 8, these reduced wall thickness regions 19 are formed by recesses 20 which start at the opposite lateral side surface of the shank 7 and are stamped into the web portions 12 to extend symmetrically toward the longitudinal center plane 21 of shank 7. FIG. 8 also shows that the reduced wall thickness regions 19 are symmetrical relative to the longitudinal center plane 21. Preferably, as shown in the illustrated embodiment, the remaining wall thickness 22 of these reduced wall thickness regions 19 is approximately equal to one-half the thickness of shank 7. The "anchor" regions 19 are therefore covered on both sides by layers of vibration damping material 13 of the same thickness.

It is advisable for irregular profile 15 to extend over the entire length of web portion 12 and the edges of guide members 10 facing opening 11, particularly if as shown in FIG. 5, there is only one web portion 12 so that the opening 11 extends to an edge of the shank 7. However, it is also conceivable for irregular profile 15 to only be provided over part of the edges defining the opening 11.

As further shown in FIG. 7, in order to further improve the form-locking connection between the vibration damping material 13 and the surrounding shank material, transverse perforations 23 may be provided in all or some of the reduced wall thickness regions 19. These perforations 23, when filled with vibration damping material 13 and constitute a type of transverse rivet between the regions of material 13 disposed on both sides of the "anchors" 19.

Finally, it must be pointed out that the reduced wall thickness regions 19 need not be locally confined to in the manner of gusset-shaped regions between adjacent recesses 16 as shown in FIG. 7. Other embodiments are also possible. For example, such a region of reduced edge thickness may extend in the form of a strip over part or all of the entire edge defining the opening 11 as indicated by the dashed line **19*a* in FIG. 6**.

The embodiments described above with reference to FIGS. 1 to 8 relate to needles whose openings 11 are defined by narrow web portions 12 having a maximum height of 1.1 mm and by guide portions 10, 10'. In these embodiments material 13 filling the openings 11 has a vibration damping effect for highly elastic structures.

However such an irregular profile 15 may also be generally used in knitting tools whose shanks include open-edged or closed openings filled with a heterogeneous material, for example a plastic material, which is firmly bonded to the outline of the opening. This material may be a plastic material which is provided, for example, to improve the seating characteristics of the needle shanks in the needle guide grooves of the needle bed.

The present invention relates to the subject matter disclosed in Federal Republic of Germany No. P 37 06 856.3 of Mar. 4, 1987, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a stamped knitting tool for textile machines, particularly knitting machines, said tool including a shank having upper and lower edges and defining two spaced solid guide portions which extend between said upper and lower edges and which are connected together by at least one narrow web portion having a maximum height of 1.1 mm so that the facing edges of said guide portions and an edge of said at least one web portion define an opening in said shank, at least one butt extending from said upper edge of said shank and aligned with one of said guide portions, and a vibration damping material filling said opening and being bonded to said shank, the improvement wherein:

at least one of said facing edges of said guide portions and said edge of said web portion has an irregular profile thereby defining means for anchoring said vibration damping material in a form-locking manner.

2. A stamped knitting tool as defined in claim 1, wherein said irregular profile includes recesses which open toward said opening.

3. A stamped knitting tool as defined in claim 2, wherein said recesses are shaped in the form of circular segments.

4. A stamped knitting tool as defined in claim 2, wherein said recesses overlap one another.

5. A stamped knitting tool as defined in claim 2, wherein said recesses are tangentially disposed next to each other.

6. A stamped knitting tool as defined in claim 2, wherein said recesses are spaced at a distance from one another.

7. A stamped knitting tool as defined in claim 6, wherein the distance between adjacent said recesses along said edges is no greater than 0.1 mm.

8. A stamped knitting tool as defined in claim 1, wherein said irregular profile includes regions of said edges which have a reduced thickness and which project into said vibration damping material filling said opening.

9. A stamped knitting tool as defined in claim 8, wherein said edge regions of reduced thickness are restricted to specific locations of said irregular profile.

10. A stamped knitting tool as defined in claim 9, wherein: said irregular profile includes recesses which are open toward said opening and form gusset-shaped portions along said edges at the transitions between adjacent recesses; and said edge regions of reduced thickness include said gusset-shaped portions.

11. A stamped knitting tool as defined in claim 8, wherein said edge regions of reduced thickness are located along the longitudinal center plane of said shank and are symmetrically disposed relative to the lateral side surfaces of said shank.

12. A stamped knitting tool as defined in claim 8, wherein said edge regions of reduced thickness have a thickness approximately equal to one half of the thickness of said shank.

13. A stamped knitting tool as defined in claim 8, wherein said edge regions of reduced thickness include perforations.

14. A stamped knitting tool as defined in claim 1, wherein said irregular profile extends over the entire length of said edges defining said opening.

15. In a stamped knitting tool for textile machines, particularly knitting machines, said tool including a shank having at least one butt and at least one opening, and a heterogeneous material filling said opening and being bonded to said shank, the improvement wherein:

the edges of said shank defining said opening have an irregular profile thereby defining means for anchoring said heterogeneous material in a form-locking manner.

16. A stamped knitting tool as defined in claim 15, wherein said irregular profile includes recesses which open toward said opening.

17. A stamped knitting tool as defined in claim 16, wherein said recesses are shaped in the form of circular segments.

18. A stamped knitting tool as defined in claim 15, wherein said irregular profile includes edge regions of reduced thickness which project into said material filling said opening.

19. A stamped knitting tool as defined in claim 18, wherein said edge regions of reduced thickness include perforations.

20. A stamped knitting tool as defined in claim 15, wherein said irregular profile extends over the entire length of said edges defining said opening.

* * * * *